United States Patent [19]

Ikenoya et al.

[11] 4,182,297

[45] Jan. 8, 1980

[54] HEAT CONTROL SYSTEM FOR A TWO-CYCLE ENGINE

[75] Inventors: Yasuo Ikenoya, Kawagoe; Masaaki Uchida, Saitama, both of Japan

[73] Assignee: Honda Giken Kogyo Kabushiki Kaisha, Tokyo, Japan

[21] Appl. No.: 865,998

[22] Filed: Dec. 30, 1977

Related U.S. Application Data

[63] Continuation-in-part of Ser. No. 635,928, Nov. 28, 1975, abandoned.

[30] Foreign Application Priority Data

Dec. 7, 1974 [JP] Japan ..... 49-148192

[51] Int. Cl.[2] ..... F02M 23/04; F02B 33/04

[52] U.S. Cl. ..... 123/124 A; 123/65 R; 123/73 A; 123/119 D; 123/198 D; 137/480

[58] Field of Search ..... 123/124 A, 124 R, 124 B, 123/75 B, 106, 119 D, 119 DB, 65 R, 73 A; 137/480, 198 D

[56] References Cited

U.S. PATENT DOCUMENTS

| | | | |
|---|---|---|---|
| 1,838,408 | 12/1931 | King et al. | 123/106 |
| 1,863,715 | 6/1932 | Heitger | 123/124 A |
| 1,869,429 | 8/1932 | King et al. | 123/124 A |
| 1,872,708 | 8/1932 | Ericson | 123/124 A |
| 1,922,266 | 8/1933 | Toman | 123/124 A |
| 2,145,230 | 1/1939 | Arrigai | 123/124 A |
| 2,883,112 | 4/1959 | Stoltman | 123/124 A |
| 3,934,562 | 1/1976 | Isaka | 123/75 B |
| 3,982,507 | 9/1976 | Asaka et al. | 123/75 B |

*Primary Examiner*—Wendell E. Burns
*Attorney, Agent, or Firm*—Lyon & Lyon

[57] ABSTRACT

A two-cycle air-cooled engine has a carburetor with a throttle valve operated by a manual control member. A heat sensitive valve mounted on the engine cylinder head closes to cut off a supplementary air supply to the induction passageway and thereby richen the air-fuel mixture to prevent seizure upon overheating. When the manual control member is in position corresponding to idling of the engine, the member actuates means which introduce additional air into the induction passageway leading to the engine, to lean the air-fuel mixture.

5 Claims, 9 Drawing Figures

FIG. 3.
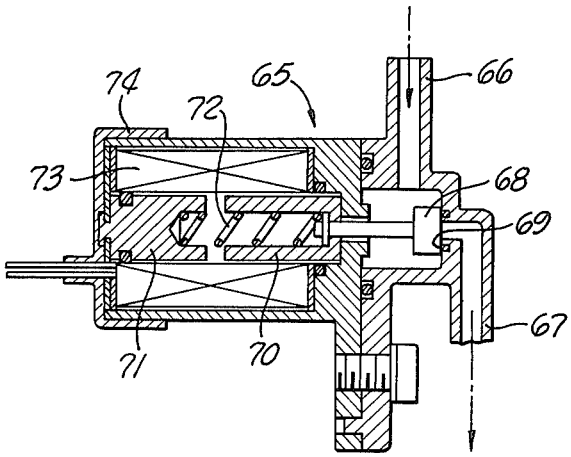
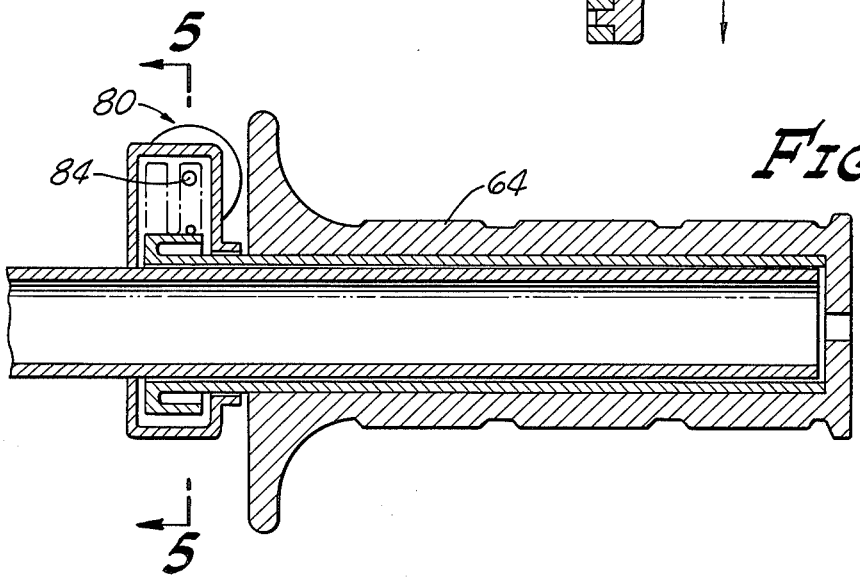
FIG. 4.
FIG. 6.
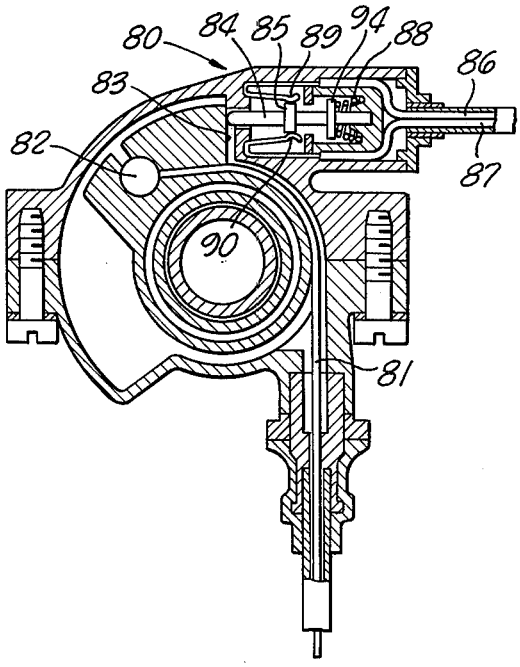
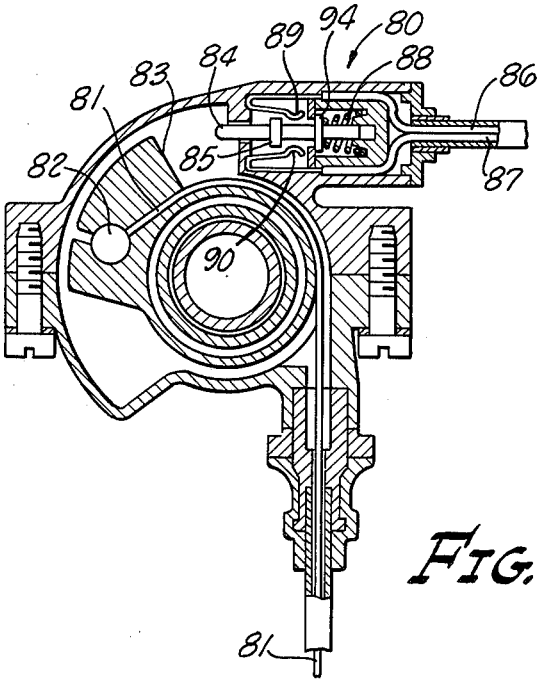
FIG. 5.

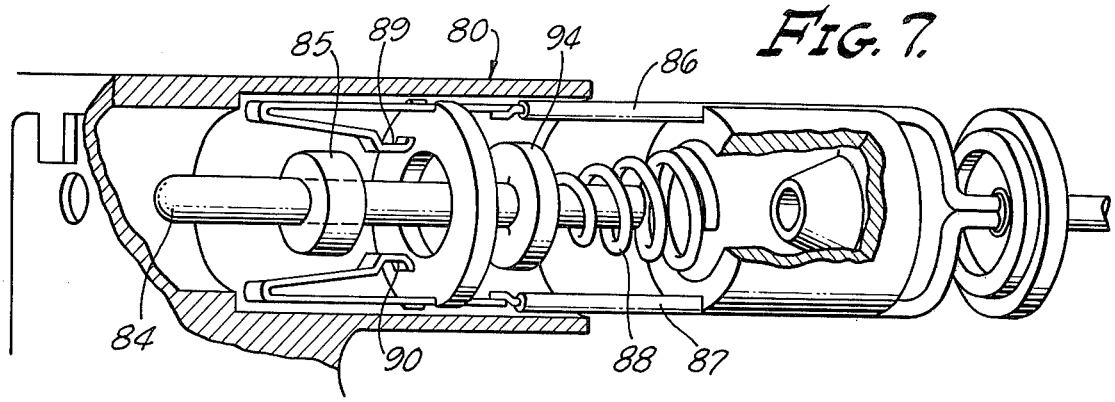
FIG. 7.
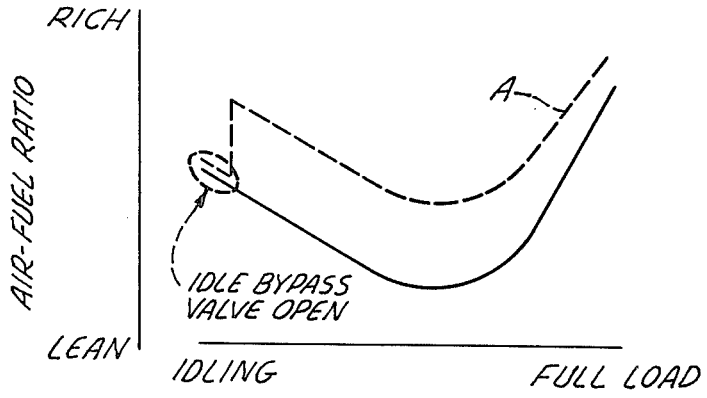
FIG. 8.
FIG. 9.
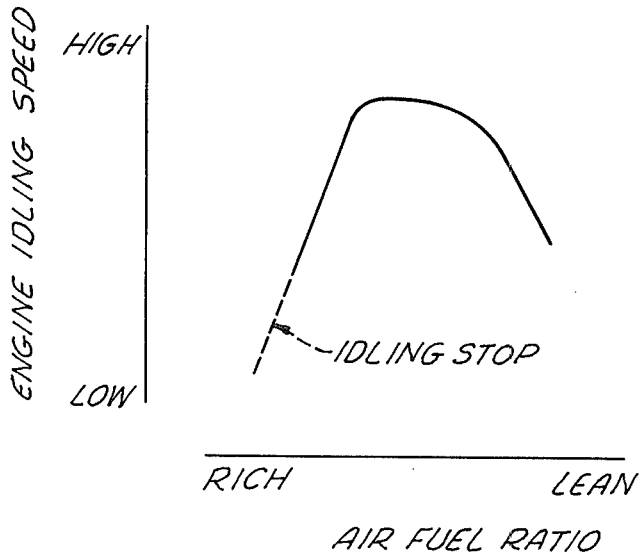

HEAT CONTROL SYSTEM FOR A TWO-CYCLE ENGINE

This application is a Continuation-in-Part of our prior application Ser. No. 635,928 now abandoned filed Nov. 28, 1975.

Conventional two-cycle air-cooled carbureted engines sometimes overheat after a long period of high speed operation, and if the overheating is severe, seizure of the piston within the cylinder may occur. In order to overcome this operational defect, this invention contemplates mounting of a temperature sensitive valve on the engine head, the valve acting to shut off the supply of supplementary air to the engine, when overheating is imminent, and thereby cause the air-fuel mixture to become richer. The excess of fuel then tends to cool the engine.

Also, if the manually controlled throttle valve of the engine carburetor should be moved to a position to cause the engine to idle, and if this should occur directly after the air-fuel ratio had been richened to prevent heat seizure, the rich air-fuel mixture then causes poor idling operation of the engine, and it may stop running. This invention contemplates the provision of means actuated by the carburetor control member for providing supplementary air to the engine whenever it is in idling operation, the supplementary air serving to lean the air-fuel mixture.

Other objects and advantages will appear hereinafter.

In the drawings:

FIG. 3 is a sectional elevation showing a solenoid valve assembly employed in connection with this invention.

FIG. 4 is a sectional elevation of a rotary handle grip for operating the engine throttle valve assembly and for operating an electrical switch used in conjunction with the solenoid valve assembly of FIG. 3.

FIG. 5 is a sectional elevation taken on the lines 5—5 as shown in FIG. 4, the position of the parts corresponding to running of the engine under load.

FIG. 6 is a view similar to FIG. 5, the position of the parts corresponding to idling of the engine.

FIG. 7 is an exploded view of the idle switch shown in FIGS. 5 and 6.

FIG. 8 is a graph showing the relationship of the richness of the air-fuel ratio plotted against the engine RPM from idling to full load.

FIG. 9 is a graph showing the relationship of the idling speed of the engine compared to the air-fuel ratio.

Figure 1:
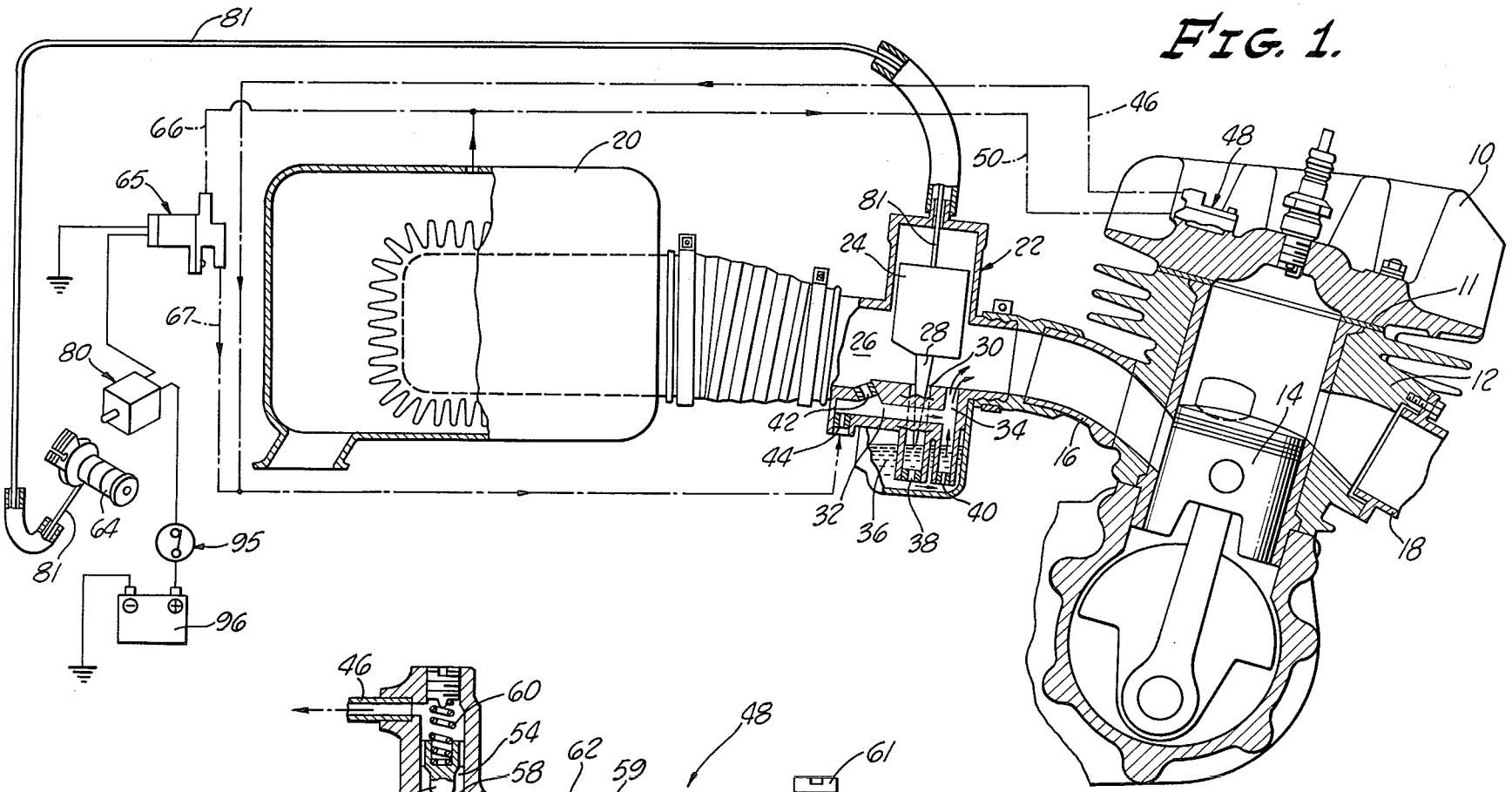
FIG. 1 is a diagrammatic representation, partly in section, of a preferred embodiment of this invention.

Referring to the drawings, the air-cooled two-stroke engine shown in FIG. 1 includes a conventional engine head 10, engine block 12, piston 14, intake pipe 16, and exhaust manifold 18. A gasket 11 is clamped between the engine head 10 and the engine block 12. An air cleaner 20 and a carburetor generally designated 22 are mounted in series ahead of the intake pipe 16.

This carburetor 22 has a piston type throttle valve 24 mounted in the main induction passageway 26. The needle valve 28 is fixed to and forms a part of the piston type throttle valve 24 for control of the main fuel nozzle 30. An auxiliary induction passageway 32 bypasses the throttle valve 24 and operates as a slow-running induction passageway, the primary function of which is to provide for proper carburetion during idling and light load conditions when the throttle valve 24 slightly opens the main induction passageway 26. An outlet 34 from the auxiliary induction passageway 32 is provided into the main induction passageway 26 near the downstream wall of the throttle valve 24, where the air-fuel mixture developed in the auxiliary induction passageway 32 is then directed into the intake pipe 16.

A fuel reservoir 36 and main jet 38 and idling jet 40 are provided for introduction of liquid fuel into the main induction passageway 26 and the auxiliary induction passageway 32. The carburetor as thus far described is generally of a conventional design.

In accordance with the present invention, first air inlet 42 and second air inlet 44 are provided to the auxiliary induction passageway 32. The first air inlet 42 draws air from the main induction passageway 26 upstream of the throttle valve 24. This first air inlet 42 somewhat restricts the flow of air through the auxiliary induction passageway 32 such that, when it alone provides incoming air to the auxiliary induction passageway 32, an overall rich air-fuel mixture is supplied to the two-cycle engine. The first air inlet 42 is proportioned in size so that an appropriately rich overall air-fuel mixture is provided to the two-cycle engine so that overheating and seizure are prevented without an undue loss in efficiency.

The second air inlet 44 is proportioned in size to provide sufficient additional air to the auxiliary induction passageway 32 such that a proper air-fuel mixture will be drawn from the auxiliary induction passageway 32 to mix with the air-fuel mixture created in the main induction passageway 26 to produce efficient operation of the two-cycle engine at normal operating temperatures. Associated with the second air inlet 44 is an air line 46 which extends from the second air inlet 44 at the auxiliary induction passageway 32 to the engine head 10. A temperature sensitive valve assembly generally designated 48 is mounted in thermal contact with the engine head for opening and closing the second air inlet 44. A supply line 50 directs air to the temperature sensitive valve assembly 48 from the air cleaner 20.

Figure 2:
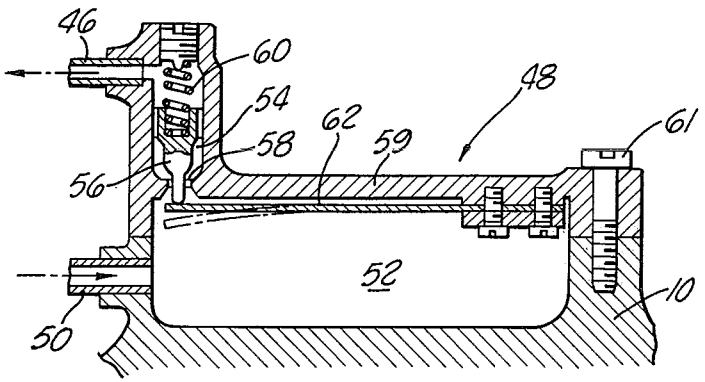
FIG. 2 is a sectional side elevation partly broken away, showing a bimetal valve assembly mounted on the cylinder head.

The temperature sensitive assembly 48 is best shown in FIG. 2. Chamber 52 receives incoming air from the supply line 50. A connecting passage 54 extends between the chamber 52 and the air delivery line, thus providing a passage from the supply line 50 through the air line 46 to the auxiliary induction passageway 32. Located within the connecting passageway 54 is a valve 56 which cooperates with a valve seat 58 to control the passage of air through the connecting passageway 54. The valve 56 is biased against the valve seat 58 by a spring 60. A bimetallic element 62 is fixed to the body 59 at one end and extends at its projecting end to contact the lower end of the valve 56 to hold it away from the seat 58. When the bimetallic element 62 is relatively cool, the valve 56 is held away from the seat 58. When the bimetallic element 62 is relatively hot, it moves to the phantom line position shown to permit the spring 60 to close the valve 56 against the seat 58, thus closing the second air inlet 44. The body 59 is mounted directly on the engine head 10, as by means of fasteners 61.

From the foregoing description it will be understood that the heat sensitive valve 48 closes the air line 46 when the cylinder head temperature is above a predetermined value brought about by heavy load operation, and closing of the air line 46 causes enrichment of the air-fuel mixture conducted into the combustion chamber of the engine to prevent heat seizure. However, if the engine should be caused to idle immediately after high speed operation for a long time, the idling speed of the engine may fall below acceptable limits or the engine may actually stop because of the over-rich air-fuel mixture provided when the air line 46 is closed.

In order to overcome this operating deficiency, a bypass air line 66 is provided and placed in parallel with the air lines 50 and 46. An idle bypass valve generally designated 65 is positioned between the air line 66 and the air line 67. This bypass valve 65 is normally closed and is opened by electrical excitation of the solenoid 73. This solenoid is electrically connected in series with the battery 96, main switch 95, and idle switch 80. The idle switch 80 is mounted in part of the handle grip 64 so as to be operated simultaneously with the engine throttle control. The throttle wire 81 has an end 82 which is fixed to the handle grip 64. The other end of the throttle wire 81 is connected to the piston type throttle valve 24.

As best shown in FIG. 3, the bypass valve 65 has a valve head 68 which closes against valve seat 69 to cut off communication between the air line 66 and the air line 67. When the solenoid 73 is electrically energized, the movable armature 70 is lifted against the force of the spring 72 to engage the stationary element 71 secured within the cover 74. This raises the valve head 68 away from the seat 69 to establish communication between the air lines 66 and 67. When the solenoid 73 is de-energized, the spring 72 acts to close the valve head against the valve seat 69.

An exploded view of the idle switch 80 is shown in FIG. 7. The central rod 84 is made of insulating material, and it has a projecting end in the path of movement of the shoulder 83 on the handle grip 64. A collar 85 formed of electrically conducting material is fixed on the central rod 84, and in the position shown in FIG. 7 the collar 85 does not engage the contact fingers 89 and 90. The contact finger 89 is connected to the lead wire 86 and the contact finger 90 is connected to the lead wire 87. A conical coil spring 88 encircles a portion of the central rod 84 and engages a second collar 94 fixed on the rod 84 to bias the rod 84 to the projected position which corresponds to the "off" position of the switch. When the shoulder 83 on the handle grip 64 is moved to idle position, as shown in FIG. 6, the rod is pushed back against the spring 88 to cause the contact fingers 89 and 90 both to engage the electrically conducting collar 85, thus completing an electrical circuit through the lead wires 86 and 87. This, in turn, energizes the solenoid 73 to lift the valve head 68 away from the valve seat 69. The air then passes from air line 66 through air line 67 through the second air inlet 44 and into the auxiliary induction passageway 32 and into the engine intake pipe 16. The additional air makes the air-fuel mixture leaner and then the engine continues to idle at the desired speed, without stopping.

From this description it will be understood that turning of the handle grip 64 in a direction to cause the engine to operate at idle speed serves to close the idle switch 80 to energize the solenoid 73 and thereby permit additional air to pass into the carburetor to lean the air-fuel mixture. When the handle grip 64 is turned to cause the engine to run at speeds above idle, communication between the air lines 66 and 67 is cut off. Should continued high speed running of the engine cause overheating, the temperature sensitive valve assembly 48 closes to cut off the supply of air through the second air inlet 44, thereby enriching the air-fuel ratio of the mixture delivered to the engine through the intake pipe 16, thereby preventing seizure of the engine under overheated conditions.

The dashed line curve A of FIG. 8 shows the variation in air-fuel ratio between idling and full load of the engine when the engine head temperature is high. The full line curve of FIG. 8 shows the same relationship when the engine head temperature is low. During idling of the engine, the bypass valve 65 is open so that the two curves are substantially coincident over the idle range.

FIG. 9 shows the variation in engine idling speed as the air-fuel ratio changes over a range from rich to lean. The dashed portion of the curve indicates minimum engine RPM during idling, depending on the position of the idling stop.

Having fully described our invention, it is to be understood that we are not to be limited to the details herein set forth, but that our invention is of the full scope of the appended claims.

We claim:

1. In a two-cycle air-cooled engine having a carburetor for supplying a controlled air-fuel mixture to the engine and having an induction passageway including a first air inlet and a fuel inlet, fuel being drawn into said induction passageway through the fuel inlet by passage of air through said induction passageway, the improvement comprising: a second air inlet to said induction passageway, an air line connected to said second air inlet, a heat sensitive valve assembly mounted on the engine head and operatively interposed in said air line, so that when the engine is operating at normal temperatures said air line remains open to supply additional air to the induction passageway, and so that excessive temperature of the engine head causes the valve assembly to close and thereby enrich the mixture being supplied through the induction passageway to prevent seizure, the carburetor having a throttle valve, means including a manually operated control member for operating said throttle valve, means including another valve for delivering additional air into said induction passageway, said means being responsive to the position of said control member, whereby the air-fuel mixture in the induction passageway is leaned by the addition of air when the engine is idling.

2. In a two-cycle air-cooled engine having a carburetor having a throttle valve for supplying a controlled air-fuel mixture to the engine and having an induction passageway including a first air inlet and a fuel inlet, fuel being drawn into said induction passageway through the fuel inlet by passage of air through said induction passageway, the improvement comprising: additional air inlet means to said induction passageway, a heat sensitive valve assembly mounted on the engine head and operatively connected to said air inlet means, so that when the engine is operating at normal temperatures said valve assembly remains open to supply additional air to the induction passageway, and so that excessive temperature of the engine head causes the valve assembly to close and thereby enrich the mixture being supplied through the induction passageway to prevent seizure, means including a manually operated control member for operating said throttle valve, means including another valve for delivering additional air into said induction passageway, said means being responsive to the position of said control member, whereby the air-fuel mixture in the induction passageway is leaned by the addition of air when the engine is idling.

3. In a two-cycle air-cooled engine having a carburetor for supplying a controlled air-fuel mixture to the engine and having an induction passageway including a first air inlet and a fuel inlet, fuel being drawn into said induction passageway through the fuel inlet by passage of air through said induction passageway, the improvement comprising: a second air inlet to said induction passageway, an air line connected to said second air inlet, a heat sensitive valve assembly mounted on the engine head and operatively interposed in said air line, so that when the engine is operating at normal temperatures said air line remains open to supply additional air to the induction passageway, and so that excessive temperature of the engine head causes the valve assembly to close and thereby enrich the mixture being supplied through the induction passageway to prevent seizure, the carburetor having a throttle valve, means including a manually operated control member for operating said throttle valve, a bypass valve operatively positioned in parallel with said air line including said heat sensitive valve, means whereby movement of the control member to idle position serves to open the bypass valve, whereby the air-fuel mixture in the induction passageway is leaned by the addition of air when the engine is idling.

4. In a two-cycle air-cooled engine having a carburetor for supplying a controlled air-fuel mixture to the engine and having an induction passageway including a first air inlet and a fuel inlet, fuel being drawn into said induction passageway through the fuel inlet by passage of air through said induction passageway, the improvement comprising: a second air inlet to said induction passageway, an air line connected to said second air inlet, a heat sensitive valve assembly mounted on the engine head and operatively interposed in said air line, so that when the engine is operating at normal temperatures said air line remains open to supply additional air to the induction passageway, and so that excessive temperature of the engine head causes the valve assembly to close and thereby enrich the mixture being supplied through the induction passageway to prevent seizure, the carburetor having a throttle valve, means including a manually operated control member for operating said throttle valve, an electric switch operated by said manual control member, a solenoid operated valve connected to said electric switch and moved to open position when the manual control member is moved to idle position, said solenoid valve being operatively positioned in parallel with said air line including said heat sensitive valve whereby the air-fuel mixture in the induction passageway is leaned by the addition of air when the engine is idling.

5. In a two-cycle air-cooled engine having a carburetor having a throttle valve for supplying a controlled air-fuel mixture to the engine and having an induction passageway including a first air inlet and a fuel inlet, fuel being drawn into said induction passageway through the fuel inlet by passage of air through said induction passageway, the improvement comprising: means including a manually operated control member for operating said throttle valve, additional air inlet means to said induction passageway, an air line connected to said second air inlet, a heat sensitive valve assembly mounted on the engine head and operatively connected to said air inlet means, so that when the engine is operating at normal temperatures said valve assembly remains open to supply additional air to the induction passageway, and so that excessive temperature of the engine head causes the valve assembly to close and thereby enrich the mixture being supplied through the induction passageway to prevent seizure.

* * * * *